United States Patent [19]

Sekiya et al.

[11] 4,258,431

[45] Mar. 24, 1981

[54] ELECTRONIC TIMEPIECE HAVING AN ANALOG DISPLAY DEVICE AND A DIGITAL DISPLAY DEVICE

[75] Inventors: Fukuo Sekiya, Tokorozawa; Takashi Yamada, Sayama, both of Japan

[73] Assignee: Citizen Watch Co., Ltd., Tokyo, Japan

[21] Appl. No.: 966,915

[22] Filed: Dec. 6, 1978

[30] Foreign Application Priority Data

Dec. 9, 1977 [JP] Japan ..... 52-147796
Feb. 16, 1978 [JP] Japan ..... 53-18780[U]

[51] Int. Cl.[3] ..... G04C 9/00

[52] U.S. Cl. ..... 368/188; 368/76; 368/82; 368/83; 368/187; 368/189; 368/241

[58] Field of Search ..... 368/76, 82, 83, 187, 368/188, 189, 241

[56] References Cited

U.S. PATENT DOCUMENTS 3,810,356 5/1974 Fujita ..... 368/188
3,911,665 10/1975 van Berkum ..... 368/82 X

*Primary Examiner*—Ulysses Weldon
*Attorney, Agent, or Firm*—Jordan and Hamburg

[57] ABSTRACT

An electronic timepiece having both time indicating hands and an electro-optical time display, wherein individual digits of the electro-optical display can be selected for correction and wherein correction of a digit causes the time indicating hands to advance by a precisely corresponding amount.

11 Claims, 2 Drawing Figures

Figure 1:
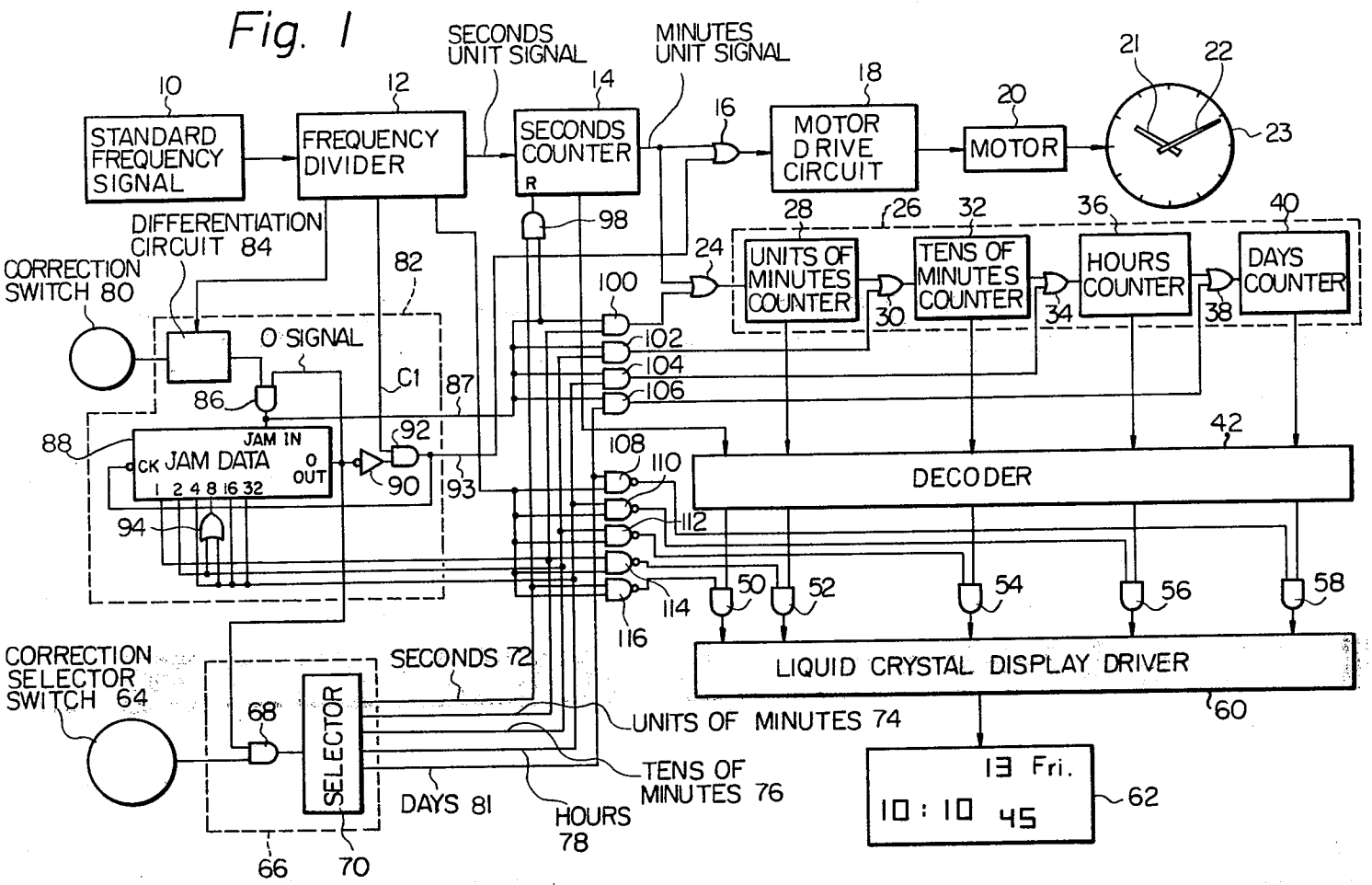

ELECTRONIC TIMEPIECE HAVING AN ANALOG DISPLAY DEVICE AND A DIGITAL DISPLAY DEVICE

This invention relates to correction means for an electronic timepiece having both analog time display by time indicating hands and digital time display by an electro-optical display, wherein individual digits of said digital time display can be selected for correction.

Various designs of electronic timepieces have been proposed heretofore in which time is displayed by means of time indicating hands. In some of such designs, an electro-optical display is also incorporated in order to display the date and, in some cases, the day of the week. However a difficulty which arises in such designs is that it is difficult to provide circuit means for extracting the time information displayed by the time indicating hands in order to enable the date and weekday displays to be advanced. It is also difficult to provide electronic circuit means for an alarm function with such types of timepiece, due to the difficulties which are encountered in attempting to detect the angles of rotation of the time indicating hands.

Other designs of electronic timepieces have also been proposed heretofore in which a digital display of time is provided by means of an electro-optical display which is driven in synchronism with the time indicating hands, so that both an analog and digital type of time indication are provided. In such a timepiece, it is desirable to be able to select individual digits of the digital display for correction, i.e. for setting to some desired numeric value. However in this case, it is difficult to link this correction to correction of the positions of the time indicating hands. For example, if the tens of minutes digit of the digital display is corrected from a value of one to a value of two, then it is necessary for the minutes hand of the timepiece to be simultaneously advanced by ten minutes.

The present invention overcomes the difficulties enumerated above with conventional types of electronic timepieces, and enables an electronic timepiece having both time display by time indicating hands and by a digital type of electro-optical display, in which individual digits of the electro-optical display can be selected and corrected, and in which the time indicating hands are advanced by an amount which corresponds precisely to the correction of the electro-optical display digit, when such correction is performed. In addition, with an electronic timepiece in accordance with the present invention, it is possible for the timepiece user to select any digit of the electro-optical display for correction, by actuating an external operating member. Subsequently, the digit to be corrected is advanced by one, each time the user actuates another external operating member, called the correction switch. Each time the correction switch is actuated, a number of pulses are applied to a circuit which drives the motor for rotating the time indicating hands, and this number of pulses corresponds precisely to the amount by which the digital display has been advanced. For example, if the tens of minutes digit is selected for correction, and the correction switch is actuated once, then the tens of minutes digit will be advanced by one. At the same time, ten pulses will be applied in rapid succession to the circuit driving the timepiece motor, causing the minutes hand of the timepiece to be advanced by ten minutes. If the tens of minutes digit was previously indicating a value of five, then actuating the correction switch will cause a carry signal to be generated such that the least significant of the hours digits is advanced by one, while the tens of minutes digit is caused to indicate zero. Thus, the time displayed by the time indicating hands and that displayed by the electro-optical display will always remain identical, when correction is performed. It is therefore possible for correction of a digit of the electro-optical display to result in carry being performed to the higher order digits of the display, while correction is being conducted. With conventional designs of electronic timepieces having both analog and digital displays, such carry operations have been inhibited while correction is being performed, so that, for example, advancement of the hours digits during correction of the digital display does not cause a carry to the date or weekday digits, in such a conventional timepiece.

In addition, since an electronic timepiece according to the present invention incorporates electronic counter circuits in which time information is registered, an alarm function can easily be added, by utilizing electronic circuit means.

It is therefore an object of the present invention to provide an improved type of electronic timepiece having both digital and analog forms of time display.

More particularly, it is an object of the present invention to provide an improved type of electronic timepiece having both digital and analog forms of time display in which individual digits of said digital display can be selected for correction and can be corrected, and in which said analog time display is automatically corrected by an amount precisely corresponding to said correction of said individual digit of said digital display.

Further objects, features and advantages of the present invention will be made more apparent from the following description, when taken in conjunction with the attached drawings, whose scope is given by the appended claims.

Figure 2:
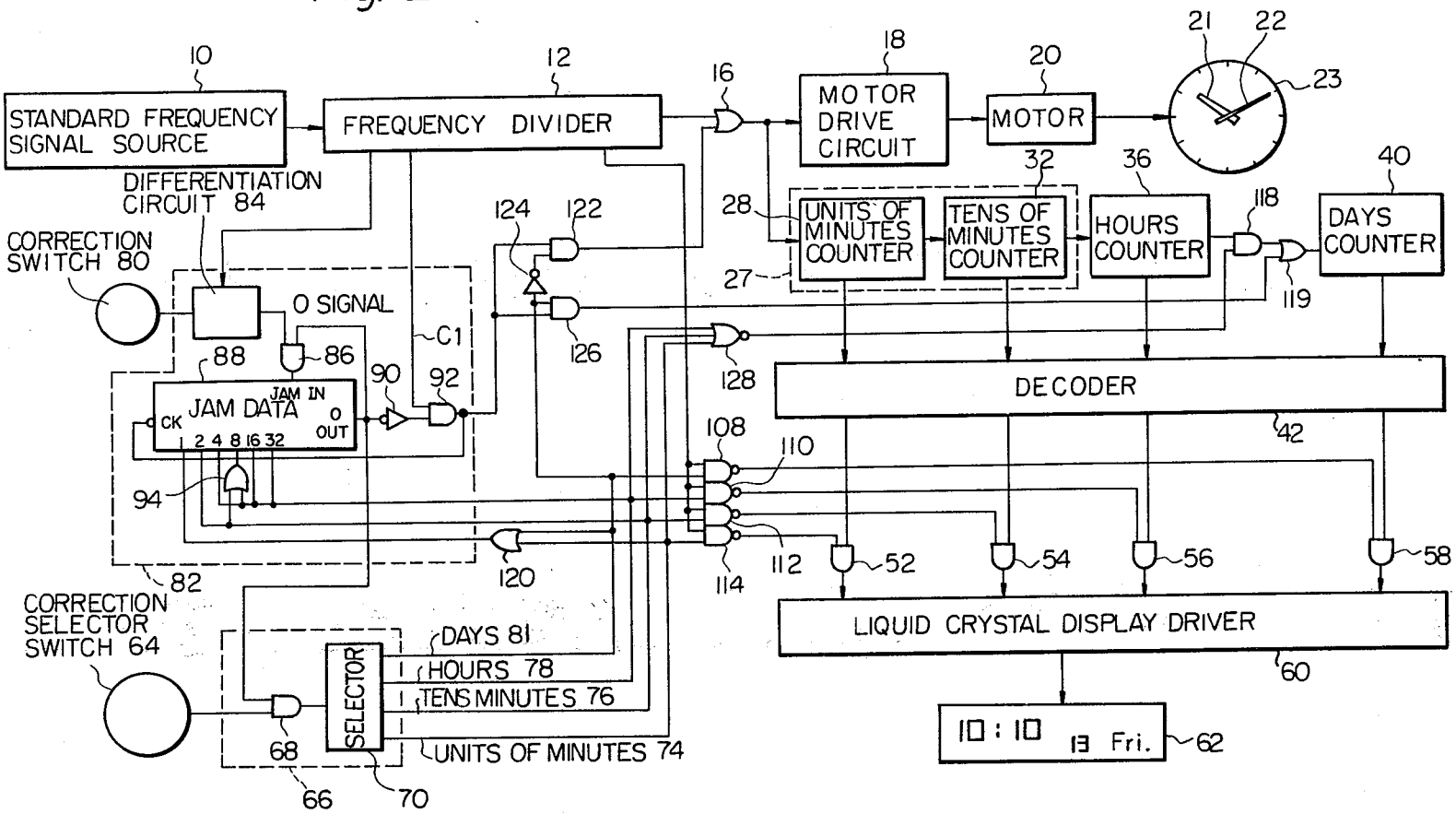

In the drawings:

FIG. 1 is a block diagram of a first embodiment of an electronic timepiece in accordance with the present invention, in which a digital display of seconds, minutes, hours and weekdays is provided; and FIG. 2 is a block diagram of a second embodiment of an electronic timepiece in accordance with the present invention, in which a digital display of minutes, hours and dates is provided.

Referring now to the drawings, FIG. 1 is a block diagram of a first embodiment of an electronic timepiece according to the present invention. A standard frequency signal source, such as a quartz-crystal controlled oscillator circuit, produces a standard frequency signal which is applied to a frequency divider circuit 12. Frequency divider circuit produces a standard time signal having a frequency of 1 Hz, which is applied to a seconds counter 14, which counts the seconds of time. Seconds counter 14 produces a minutes unit signal, having a period of one minute, which is applied through an OR gate 16 to a motor drive circuit 18. An output from motor drive circuit 18 drives a stepping motor 20, which rotates time indicating hands 21 and 22 of analog time display 23.

The minutes unit signal from seconds counter 14 is also applied through an OR gate 24 to a units of minutes counter circuit 28 , in a time counter circuit 26. An output signal from units of minutes counter circuit 28, having a period of ten minutes, is applied through an OR gate 30 to a tens of minutes counter circuit 32. An output signal from tens of minutes counter circuit 32, having a period of one hour, is applied through an OR gate 34 to an hours counter circuit 36. An output signal from hours counter circuit 36, having a period of 24 hours, is applied through an OR gate 38 to a days counter circuit 40.

Output signals corresponding to the contents of seconds counter circuit 14, units of minutes counter circuit 28, tens of minutes counter circuit 32, hours counter circuit 36 and days counter circuit 40, are applied to a decoder circuit 42. Decoder circuit 42 produces display segment signals corresponding to the seconds, units of minutes, tens of minutes, hours and days digits, and these segment signals are applied through AND gates 50, 52, 54, 56 and 58 to a liquid crystal display driver circuit 60. Output signals from liquid crystal display driver circuit 60 are applied to a liquid crystal type of opto-electronic display 62, so that the seconds, minutes, hours and days of time are displayed. Days counter 40 actually consists of a counter circuit for counting the days of the months and a counter for counting the days of the week, so that both the date and weekday can be indicated by liquid crystal display 62. However for the sake of simplicity of description, only a signal output is shown from days counter 40 to decoder circuit 42, and from decoder circuit 42, through AND gate 58, to liquid crystal display driver circuit 60.

Numeral 64 indicates a correction selector switch, which is actuated by the user in order to select a digit of opto-electronic display 62 to be corrected. Correction selector switch 64 is coupled to an input of an AND gate 68, of a correction selection circuit 66. The output of AND gate 68 is connected to an input of a selector circuit 70. Selector circuit 70 functions in a similar manner to a shift register, so that successive low logic level (referred to hereinafter as the L level) to high logic level (referred to hereinafter as the H level) transitions at the output of AND gate 68 cause a seconds digit output line 72, units of minutes output line 74, tens of minutes output line 76 and days output line 81 to go from the L level to the H level.

Numeral 80 designates a correction switch, which is coupled to a differentiator circuit 84 in a correction pulse generation circuit 82. A high frequency signal is also applied to differentiator circuit 84 from frequency divider circuit 12. This circuit produces a single pulse of short duration each time correction switch 80 is actuated, with the effects of switch bounce being eliminated. The output of differentiator circuit 84 is applied to an AND gate 86, the output of which is connected to the JAM IN terminal of a special type of presettable down counter circuit 88. This circuit has an output terminal, designated O OUT, a clock signal input terminal Ck, and six data input terminals which are assigned binary weighting factors of 1, 2, 4, 8, 16 and 32 respectively. If a pulse is applied to the JAM IN terminal, then the O OUT terminal, which is normally at the H level, goes to the L level, if at least one of the JAM DATA terminals is at the H level. Clock pulses are applied to the clock terminal Ck. When a number of pulses equal to the total numeric value of the weighting factors of the JAM DATA inputs have been applied to the clock terminal, then the O OUT terminal again goes to the H level. For example, if JAM DATA terminals 1 and 8 are at the H level, while the other JAM DATA terminals are at the L level, and a pulse is applied to the JAM IN terminal, then the O OUT terminal will go to the L level, and remain at the L level until nine clock pulses have been applied to the clock terminal Ck, whereupon the O OUT terminal will return to the H level.

The O OUT terminal of down counter 88 is connected to the input of an inverter 90, the output of which is connected to one input of an AND gate 92. The output of AND gate 92 is applied to the clock terminal Ck of down counter 88. Output line 74 from selector circuit 70 is connected to JAM DATA terminal 1 of down counter 88. Output line 76 is connected to JAM DATA terminal 2, and to an input of an OR gate 94, the output of which is connected to JAM DATA terminal 8. Output line 78 of selector 70 is connected to JAM IN terminals 4, 16 and 32, and to an input of OR gate 94. An output of frequency divider 12, consisting of a signal having a frequency higher than the seconds unit signal, is applied to the other input of AND gate 92, this signal being designated C1. The output of AND gate 92 is applied to an input of OR gate 16. The output of AND gate 86 is connected to an input of an AND gate 98, the output of which is connected to the reset terminal of seconds counter 14, and is also connected to inputs of AND gates 100, 102, 104 and 106, which serve as correction gates.

An outut signal from frequency divider 12 is connected to inputs of a set of NAND gates 108, 110, 112, 114 and 116, the outputs of which are connected to inputs of AND gates 58, 56, 54, 52 and 50 respectively.

The operation of the correction function of the timepiece in FIG. 1 will now be described. First, let us assume that the seconds of time are to be corrected. In this case the timepiece user first actuates correction selector switch 64 an appropriate number of times to select the seconds correction, thereby causing output line 72 of selector circuit 70 to go to the H level. At an appropriate instant subsequently, for example in response to a standard time signal, the user then actuates correction switch 80, causing a pulse to be produced by differentiator circuit 84. At this time, the O OUT terminal of down counter 88 is at the H level, so that a pulse is output from AND gate 86, and is applied to AND gate 98. A pulse is therefore produced by AND gate 98, which is enabled by the H level condition of output line 72. The contents of seconds counter 14 are therefore reset to zero, causing the seconds portion of liquid crystal display 62 to become zero. Since the pulse applied to reset seconds counter 14 is of very short duration, seconds counter 14 will almost immediately begin counting from zero, after correction switch 80 has been actuated.

If the user now actuates correction selector switch 64 once more, a pulse is produced from AND gate 68 which causes selector circuit 70 to reset output line 72 to the L level and to set output line 74 to the H level. The units of minutes digit of liquid crystal display 62 is now selected for correction. In this condition, when correction switch 80 is actuated, a pulse is output by differentiator circuit 84, and therefore by AND gate 86. JAM DATA terminal 1 is at the H level, since this terminal is connected to output line 74. The O OUT terminal of down counter 88 goes to the L level, so that the output of inverter 90 goes to the H level, enabling AND gate 92 to pass pulses C1 from frequency divider 12 to the clock terminal of down counter 88. After one clock pulse has been input to this clock terminal, the O OUT terminal returns to the H level, since JAM DATA input terminal 1 is at the H level while all other inputs are at the L level, i.e. since the total of the weighting factors of the JAM DATA inputs is one. The output of inverter 90 therefore returns to the L level after one pulse has been produced by AND gate 86, thereby inhibiting AND gate 92.

The single pulse produced in this way by AND gate 86 causes an output pulse to be produced by AND gate 100, which is enabled by the H level condition of output line 74 of selector circuit 70. An output pulse is therefore produced by OR gate 24, causing the units of minutes counter 28 to be incremented by one count. As a result, the units of minutes portion of display 62 is incremented by one.

The single pulse produced by AND gate 92, as described above, is applied to OR gate 16, causing an input pulse to be applied to motor drive circuit 18. As a result, motor drive circuit 18 causes motor 20 to drive timekeeping hand 22 forward by an angle corresponding to one minute. In this way, when the units of minutes are selected for correction by actuation of correction selector switch 64, each subsequent actuation of correction switch 80 causes both the time indication by hands 21 and 22 and by liquid crystal display 62 to be advanced by one minute.

In this condition, if correction selector switch 64 is actuated once more, output line 76 of selector circuit 70 goes to the H level, while output line 74 is reset to the L level. The tens of minutes are now selected for correction. When correction switch 80 is now actuated, the output pulse produced thereby from AND gate 86 and applied to the JAM IN terminal of down counter 88 causes the O OUT terminal of down counter 88 to go to the L level, so that the output of inverter 90 enables AND gate 92 to pass pulses C1 from frequency divider circuit 12. Since output line 76 of selector circuit 70 is at the H level, H level inputs are applied to the JAM DATA terminals 2 and 8 (in the latter case, the H level input is applied from the output of OR gate 94). The total of the weighting factors of the JAM DATA inputs is therefore 10, so that the O OUT terminal remains at the L level until ten pulses have been applied to the clock terminal of down counter 88 from the output of AND gate 92. The O OUT terminal then returns to the H level, so that AND gate 92 is inhibited by the output from inverter 90, further pulses from being applied to the clock terminal of down counter 88.

The single pulse produced by AND gate 86 which initiates the production of ten successive correction pulses from AND gate 92, as described above, is applied to correction AND gate 102. Correction AND gate 102 is enabled due to the H level condition of output line 76 of selector circuit 70, so that an output pulse is produced which is applied to OR gate 30. OR gate 30 therefore produces a pulse which causes the tens of minutes counter 32 to be incremented by one. As a result, the tens of minutes digit of liquid crystal display 62 is advanced by one. If the contents of tens of minutes counter 32 had a value of 5, prior to correction being performed, then the correction operation described above will cause the contents of the tens of minutes counter to be reset to zero, and a carry pulse to be applied through OR gate 34 to the hours counter circuit 36. In such a case therefore, the contents of the hours counter 36 would be incremented by one.

The ten successive correction pulses produced from AND gate 92 as described above are applied through OR gate 16 to motor drive circuit 18, causing the time indicating hands 21 and 22 to be advanced by an amount corresponding to ten minutes. In this way, when the tens of minutes have been selected for correction, each subsequent actuation of correction switch 81 causes both the time indication by hands 21 and 22 and by liquid crystal display 62 to be advanced by ten minutes. In addition, the correction operation can result in a carry being performed to the hours counter of time counter circuit 26.

If now correction selector switch 64 is again actuated, output line 78 of selectro circuit 70 goes to the H level, while output line 76 is reset to the L level. The hours digits are now selected for correction. When correction switch 80 is now actuated, the output pulse which is thereby produced from AND gate 86, and applied to the JAM IN terminal of down counter 88. The O OUT terminal of down counter 88 therefore goes from the H level to the L level, so that the H level output from inverter 90 enables AND gate 92 to pass pulses C1 from frequency divider circuit 12. Due to the H level condition of output line 78 of selector circuit 70, H level inputs are applied to JAM DATA input terminals 4, 8, 16 and 32 of down counter 88 (the input to JAM DATA terminal 8 being applied through OR gate 94). The total of the weighting factors of the JAM DATA inputs is therefore 60. Thus, the O OUT terminal of down counter 88 remains at the L level until 60 correction pulses have been successively output from AND gate 92 and applied to the clock terminal of down counter 88, whereupon the O OUT terminal returns to the H level.

The single pulse produced by AND gate 86, which initiated the production of 60 successive correction pulses from AND gate 92 as described above, is applied to AND gate 104. AND gate 104 is enabled by the H level condition of output line 78 of selector circuit 70, so that a single pulse is applied through OR gate 34 to the hours counter 36. The contents of hours counter circuit 36 are therefore incremented by one, causing the hours digits of liquid crystal display 62 to be advanced by one hour.

The sixty successive correction pulses produced by AND gate 92 as described above are applied through OR gate 16 to motor drive circuit 18, causing time indicating hand 21 to be advanced by one hour. In this way, when the hours digits have been selected for correction by actuation of correction selector switch 64, each subsequent actuation of correction switch 81 causes the hours digits of liquid crystal display 62, together with time indicating hand 21 of analog display 23, to be advanced by one hour.

The embodiment shown in FIG. 1 also comprises an AM/PM counter which is advanced once in every 12 hours, and which is omitted from FIG. 1 for reasons of simplicity of description. If the contents of hours counter 36 corresponded to 12 PM prior to a correction operation being performed as described above, then the correction operation will cause the contents of hours counter 36 to be set to a value corresponding to 1 PM, while a carry signal is transferred through OR gate 38 to days counter 40, thereby causing the contents of days counter 40 to be incremented by one. The date and weekday indicated by liquid crystal display 62 will therefore be advanced by one day.

If correction selector switch 64 is actuated once more, then output line 81 of selector circuit 70 goes to the H level, while output line 78 is reset to the L level. The days digits are now selected for correction. When correction switch 80 is actuated thereafter, an output pulse is produced from AND gate 86 and applied to the JAM IN terminal of down counter 88, causing the O OUT terminal to go from the H to the L level. Inverter 90 now produces an H level output, enabling AND gate 92 to pass pulses C1 to the clock terminal of down counter 88. Since output line 81 of selector circuit 70 is now at the H level, AND gate 106 is enabled to pass the single pulse produced by AND gate 86 as a result of actuation of correction switch 80. However, since no H level input is applied to the JAM DATA terminals of down counter 88, the O OUT terminal of down counter 88 does not go to the L level when correction switch 80 is actuated.

An output pulse is therefore produced by AND gate 106, which is applied through OR gate 38 to days counter 40, thereby incrementing the contents of day counter 40 by one. The date and weekday indicated by liquid crystal display 62 are therefore advanced by one day, each time correction switch 80 is actuated in this condition. Since AND gate 92 is held inhibited by the output of inverter 90, no correction pulses are applied to OR gate 16, so that time indicating hands 21 and 22 are not affected by the days correction operation.

When either the seconds, units of minutes, tens of minutes, hours or days digits are selected for correction, then the corresponding one of NAND gates 116, 114, 112, 110 or 108 is enabled, by output line 81, 78, 76, 74 or 72 going to the H level as described above. A periodic output signal is therefore produced from the NAND gate which has been thus enabled, due to the output of frequency divider 12 which is applied in common to inputs of NAND gates 108 to 116. This periodic output signal is applied to one of AND gates 50, 52, 54, 56 or 58, causing the display segment signals output from decoder circuit 42 which correspond to the selected digit to be modulated, i.e. to be periodically switched on and off. The display digit (or digits) selected for correction is thereby caused to flash on and off periodically, on liquid crystal display 62. This feature provides a clear indication to the timepiece user that a particular digit has been selected for correction. It also notifies the user of the precise amount by which the time indicating hands 21 and 22 will be advanced each time correction switch 80 is advanced. Time correction can therefore be performed quickly and easily with an electronic timepiece in accordance with the first embodiment of the present invention described above.

Although the present invention has been described above with relation to an electronic timepiece having both time indicating hands and an electro-optical type of digital time display, it is also applicable to correction means for an electronic timepiece which does not have a digital display of time but only time indicating hands. In this case, indication means controlled by output lines from selector circuit 70 can indicate the number of correction pulses which will be applied to motor drive circuit 18 when correction switch 80 is actuated. Indication can be by means of numerals or other symbols.

Referring now to FIG. 2, a second embodiment of an electronic timepiece in accordance with the present invention is shown therein. A standard frequency signal is supplied by standard frequency signal source 10, which is applied to a frequency divider circuit 12. This frequency divider combines the functions of frequency divider 12 and seconds counter 14 of the first embodiment of the present invention described above, and produces an output signal having a period of one minute. This output signal is applied through an OR gate 16 to a motor drive circuit 18, which drives a motor 20 to rotate time indicating hands 21 and 22 of analog time display 23. In FIG. 2, circuit components and blocks having the same numerals as are indicated in FIG. 1 have similar operation and functions to the corresponding components and blocks in FIG. 1. Thus, correction selector switch is actuated by the timepiece user in order to select correction of time information. In the second embodiment of the present invention, the units of minutes, tens of minutes, hours or days can be selected for correction by actuating correction selector switch 64 to cause one of output lines 74, 76, 78 and 81 to go to the H level, while the remaining output lines of selector circuit 70 are set to the L level.

Output line 74 of selector circuit 70 is connected to inputs of NAND gate 114 and a NOR gate 128, and is coupled to JAM DATA terminal 1 of down counter 88 in selection pulse generation circuit 82, through an OR gate 120. Output line 76 of selector circuit 70 is coupled to inputs of NAND gate 112 and NOR gate 128, as well as to JAM DATA terminal 2 and 8 of down counter 88, being coupled to JAM DATA terminal 8 through OR gate 94. Output line 78 is coupled to inputs of NAND gate 110 and NOR gate 128, as well as to JAM DATA terminals 4, 8, 16 and 32 of down counter 88, being coupled to JAM DATA terminal 8 through OR gate 94. Output line 81 of selector circuit 70 is coupled to inputs of NAND gate 108, AND gate 126, and inverter 124. The output of NOR gate 128 is coupled to an input of and AND gate 118, which also receives the carry output signal from hours counter 36 on another input terminal. The output of AND gate 118 is applied to an input of an OR gate 119, the output of which is connected to days counter 40. The output of AND gate 126 is connected to an input of OR gate 119. The output of AND gate 92 of correction pulse generation circuit 82 is connected to inputs of AND gates 122 and 126, while the output of inverter 124 is connected to an input of AND gate 122. In the embodiment shown in FIG. 2, the carry output of units of minutes counter 28 is input directly to tens of minutes counter 32, and the carry output of tens of minutes counter 32 is applied directly to hours counter 36.

The operation of this second embodiment will now be described. First, we shall assume that the units of minutes digit is to be corrected. In this case, the timepiece user actuates correction selector switch to cause output line 74 of selector circuit 70 to go to the H level, while output lines 76, 78 and 81 are set to the L level. A periodically varying output signal is therefore produced by NAND gate 114, which modulates the display segment signal for the units of minutes digit by periodically inhibiting AND gate 52. The units of minutes digit on liquid crystal display 62 is therefore caused to flash on and off repetitively, indicating that this digit has been selected for correction. The H level of output line 74 also causes an H level output to be produced by OR gate 120, so that the total of the weighting factors of the JAM DATA terminals of down counter 88 in correction pulse generation circuit 82 becomes one. Subsequently therefore, a single pulse is produced by AND gate 92 each time correction switch 80 is actuated, as described in relation to the first embodiment of the present invention. At this time, since output line 81 of selector circuit 70 is at the L level, the output of inverter 124 is at the H level, so that the output pulse from AND gate 92 causes a pulse to be output from AND gate 122, and applied through OR gate 16 to motor drive circuit 18 and to the units of minutes counter 28 of minutes counter circuit 27. Motor 20 is thereby caused to advance time indicating hands 21 and 22 by an amount corresponding to one minute, while the contents of units of minutes counter are incremented by one so that the units of minutes digit of liquid crystal display 62 is advanced by one. If the units of minutes counter contents had a value of a value of nine prior to correction being conducted, then the correction operation causes the units of minutes counter contents to be reset to zero and a carry to be generated and applied to the tens of minutes counter 32, so that the tens of minutes are incremented by one.

Unless correction of the days digits has been selected, output line 81 of selector circuit 70 remains at the L level. AND gate 126 is therefore inhibited, so that correction pulses produced by AND gate 92 are not transferred to OR gate 119 Also, while any of the units of minutes, tens of minutes and hours digits has been selected for correction, so that one of output lines 74, 76 and 78 of selector circuit 70 is at the H level, an L level output is produced from NOR gate 128, which inhibits AND gate 118 from transferring any carry output signal produced by hours counter circuit 36 to days counter 40, so long as correction of an hours or minutes digit is selected.

If correction selector switch 64 is now actuated once more, with output line 74 at the H level, then selector circuit 70 will be caused to set output line 74 to the L level and output line 76 to the H level. This causes a periodically varying output signal to be produced by NAND gate 112 which modulates the tens of minutes display segment signal, by periodically inhibiting AND 54, causing the tens of minutes digit of liquid crystal display 62 to flash on and off, thereby indicating that the tens of minutes have been selected for correction. H level inputs are now being applied to JAM DATA terminals 2 and 8 of down counter 88. When correction switch is subsequently actuated therefore, a set of ten consecutive pulses will be generated from AND gate 92, and applied through AND gate 122 and 16 to motor drive circuit 18 and units of minutes counter 28. As a result, time indicating hands 21 and 22 will be advanced by an amount corresponding to ten minutes. In addition, since a count of ten will be performed by units of minutes counter 28, the previous contents of this counter will be left unchanged, but a carry output will be generated and applied to the tens of minutes counter 32, thereby causing the contents of tens of minutes counter 32 to be incremented by one. If the contents of tens of minutes counter 32 had a value of 5 prior to correction being performed, the contents will be set to zero and a carry output generated, causing the contents of hours counter 36 to be incremented by one.

If correction selector switch 64 is now actuated once more, then output line 78 goes to the H level while line 76 returns to the L level. An output signal is thus generated from NAND gate 110 to modulate the hours digits display segment signal through AND gate 56, to indicate that the hours digits have been selected for correction. An H level input is now applied from line 78 to JAM DATA terminals 4, 8, 16 and 32 of down counter 88, so that the total of the weighting factors of the JAM DATA inputs is 60. When correction switch 80 is subsequently actuated therefore, a series of 60 successive correction pulses are produced by correction circuit 82 and applied from AND gate 92 to motor drive circuit 18 through AND gate 122 and OR gate 16. Timekeeping hands 21 and 22 are therefore advanced by an amount corresponding to one hour. The contents of hours counter 36 are also incremented by one, as a result of a carry output which is generated from tens of minutes counter 32 due to the sixty correction pulses which are input to minutes counter 27 from OR gate 16. Thus, both the time indicating hands and the digital time display 60 are advanced by one hour, each time correction switch 80 is actuated, in this condition. Since AND gate 118 is inhibited by the L level output from NOR gate 128, any carry which is generated by hours counter 36 as a result of the correction process is not transferred to days counter 40.

If correction selector switch 64 is actuated once more, then output line 81 goes to the H level while line 78 returns to the L level. The display segment signal for the days digits is now modulated in AND gate 58 by a periodic output signal produced by NAND gate 108, to indicate that the days digits have been selected for correction. AND gate 126 is now enabled, while AND gate 122 is inhibited, by an L level output produced by inverter 124. Subsequently, an output pulse is produced by AND gate 126 each time correction switch 80 is actuated, since an H level input is applied to JAM DATA terminal 1 through OR gate 120, and is applied through OR gate 119 to days counter 40 to increment the contents of days counter 40 by one.

As in the case of the first embodiment of the present invention described previously, it is possible to modify the second embodiment of the present invention for use in an electronic timepiece having time indicating hands but without a digital display of time information. The correction pulse generation means of the present invention can be used to apply bursts of correction pulses of predetermined length so that the time indicating hands of the timepiece can be advanced by one minute at a time, ten minutes at a time, and so on, as determined by the setting of a correction selector switch. The indication of how much time correction will be provided for each actuation of the correction switch, for a particular setting of the correction selector switch, can be provided by means of symbols, numerals, etc. on the timepiece dial, which may be produced by electro-optical or other means. In this way, time correction in an electronic timepiece of analog type can be performed with a very high degree of precision and convenience.

Thus, although the present invention has been shown and described in relation to particular embodiments, various modifications may be made thereto which come within the scope claimed for the present invention.

What is claimed is:

1. An electronic timepiece having an analog display device and a digital display device, comprising:

a source of a standard frequency signal;

frequency divider means for dividing the frequency of said standard frequency signal to provide a low frequency signal and a standard time signal;

time counter circuit means responsive to said standard time signal for counting at least minutes and hours to provide output signals indicative of at least units of minutes digit, tens of minutes digit, units of hours digit, and tens of hours digit;

correction selector switch means;

selector circuit means coupled to said correction selector switch means and producing output signals for selecting one of said digits, of said time counter circuit means, to be corrected;

correction switch means;

correction pulse generation circuit means coupled to said correction switch means and to said selector circuit means, whereby a single actuation of said correction switch means causes a number of correction pulses to be sequentially generated by said correction pulse generation circuit means and whereby the value of said number of correction pulses is determined by logic level potentials of said output signals of said selector circuit means;

said time counter circuit means being responsive to said correction pulses to update the content of said selected digit;

motor drive circuit means to receive said standard time signal and said correction pulses; and a motor driven by said motor drive circuit means to actuate said analog display device;

said digital display device for displaying the contents of said time counter circuit means in digital form in response to said output signals from said time counter circuit means.

2. An electronic timepiece according to claim 1, and further comprising correction selection indication means coupled between said time counter circuit means and said digital display device for receiving said low frequency signal from said frequency divider means and said output signals of said selector circuit means, whereby said correction selection indication means is controlled in accordance with said logic level potentials of said output signals of said selector circuit means, for indicating said one of digits to be corrected.

3. An electronic timepiece according to claim 1 or claim 2, wherein said correction pulse generation circuit includes a presettable down counter having an output terminal to provide an output signal and wherein a count value designating a number of setting pulses to be subsequently generated is set into said presettable down counter each time said correction switch means is actuated, said count value being established by said logic level potentials of said output signals of said selector circuit means.

4. An electronic timepiece according to claim 1, wherein said time counter circuit means and said motor drive circuit means are corrected by the same time value in response to said correction pulses.

5. An electronic timepiece according to claim 3, in which said selector circuit means 66 includes gate means 68 having input terminal for inhibiting an output generated by said correction selector switch means 64 during a time interval in which said output signal of said correction pulse generation circuit means 82 is absent at said input terminal of said gate means.

6. An electronic timepiece according to claim 3, in which said correction pulse generation circuit means 82 includes gate means 86 having input terminal for inhibiting an output generated by said correction switch means 80 during a time interval in which said output signal of said correction pulse generation circuit means is absent at said input terminal of said gate means.

7. An electronic timepiece having an analog display device and a digital display device, comprising:

a source of a standard frequency signal;

frequency divider means for dividing the frequency of said standard frequency signal to provide a standard time signal and a low frequency signal;

time counter circuit means responsive to said standard time signal for counting at least units of minutes and tens of minutes to provide output signals indicative of at least units of minutes digits and tens of minutes digit;

decoder and display drive circuit means for receiving the contents of said time counter circuit means;

said digital display device driven by said decoder and display drive circuit means for displaying the contents of said time counter circuit means in digital form in response to said output signals from said time counter circuit means;

correction selector switch means;

selector circuit means coupled to said correction selector switch means and producing output signals for selecting one of said digits, of said time counter circuit means, to be corrected, and having output lines;

correction switch means;

correction pulse generation circuit means coupled to said correction switch means and to said selector circuit means, whereby a single actuation of said correction switch means causes a number of correction pulses to be sequentially generated by said correction pulse generation circuit means and whereby the value of said number of correction pulses is determined by logic level potentials of said output signals of said selector circuit means;

motor drive circuit means to receive said standard time signal and said correction pulses; and a motor, driven by said motor drive circuit means to actuate said analog display device;

said time counter circuit means being responsive to said correction pulses for counting at least units of minutes and tens of minutes.

8. An electronic timepiece according to claim 7, wherein said correction pulse generation circuit means includes a presettable counter and wherein a count value designating a number of setting pulses to be subsequently generated is set into said presettable counter each time said correction switch means is actuated, said count value being established by said logic level potentials of said output lines of said selector circuit means.

9. An electronic timepiece according to claim 7 or claim 8, and further comprising gate means for receiving said low frequency signal from said frequency divider circuit means and to receive said logic level potentials of said output lines of said selector circuit means, said gate means being coupled between said time counter circuit means and said digital display device for modulating signals applied to said digital display device to cause selective on-and-off flashing of digits appearing on said digital display device in accordance with said logic levels of said output lines of said selector circuit means.

10. An electronic timepiece according to claim 7, in which said time counter circuit means also comprises an hours counter and a days counter responsive to an output of said hours counter, and further comprising means for inhibiting a carry output signal produced by said hours counter from being applied to said days counter during time correction.

11. An electronic timepiece powered by a battery, comprising:

a source of a standard frequency signal;

frequency divider means for dividing the frequency of said standard frequency signal to provide a standard time signal;

correction selector switch means;

selector circuit means coupled to said correction selector switch means and having a plurality of output lines, whereby at least one of said output lines can be selectively set to a first logic level potential and the remainder of said output lines set to a second logic level potential by actuation of said correction selector switch means;

correction switch means;

correction pulse generation circuit means coupled to said correction switch means and to said output lines of said selector circuit means, whereby a single actuation of said correction switch means causes a single first correction pulse and a number of second correction pulses to be generated by said correction pulse generation circuit means and whereby the number of said second correction pulses thus generated is determined by said logic level potentials of said output lines of said selection circuit means;

motor drive circuit means for receiving said standard time signal and said second correction pulses;

a motor, driven by said motor drive circuit means;

time indicating hands driven by said motor;

time counter circuit means comprising at least a units of minutes counter and a tens of minutes counter connected in cascade, and wherein said standard time signal is coupled to an input terminal of said units of minutes counter;

decoder and display drive circuit means to receive the contents of said time counter circuit means;

opto-electric display means driven by said decoder and display drive circuit means for displaying the contents of said time counter circuit means in digital form; and a plurality of correction gate circuits controlled by said logic level potential levels of said output lines of said selector circuit means for selectively applying said first correction pulses to input terminals of at least said units of minutes counter and said tens of minutes counter of said time counter circuit means.

* * * * *